US005491934A

United States Patent [19]

Bigelow, Jr. et al.

[11] Patent Number: 5,491,934

[45] Date of Patent: Feb. 20, 1996

[54] TWO STORY BUILDING COLLAPSED FOR SHIPPING

[76] Inventors: Floyd E. Bigelow, Jr.; William H. Bigelow, both of P.O. Box 7064, Houston, Tex. 77248

[21] Appl. No.: 919,539

[22] Filed: Jul. 24, 1992

[51] Int. Cl.[6] ..... E04H 1/02

[52] U.S. Cl. ..... 52/79.5; 52/79.7; 52/143; 52/220.8

[58] Field of Search ..... 52/143, 79.5, 220.8, 52/220.2, 220.3, 79.5, 79.7

[56] References Cited

U.S. PATENT DOCUMENTS

| | | | |
|---|---|---|---|
| 2,701,038 | 2/1955 | Mooney | 52/143 |
| 3,593,471 | 7/1971 | Fields | 52/79.5 |
| 3,633,323 | 1/1972 | Eriksson et al. | 52/79.5 |
| 3,680,273 | 8/1972 | Bigelow, Jr. | 52/143 |
| 3,707,811 | 1/1973 | Hampson | 52/79.5 |
| 4,637,179 | 1/1987 | Bigelow, Jr. et al. | 52/79.5 |
| 4,967,520 | 11/1990 | Post, Jr. et al. | 52/79.5 |

FOREIGN PATENT DOCUMENTS

| | | | |
|---|---|---|---|
| 3267478 | 11/1991 | Japan | 52/220.2 |

*Primary Examiner*—Carl D. Friedman
*Assistant Examiner*—Christopher Todd Kent
*Attorney, Agent, or Firm*—M. H. Gay

[57] ABSTRACT

A two story building provided by modules which may be shipped with one or both stories collapsed and with plumbing manifolds factory installed in the base frame and in the ceiling-floor between stories.

4 Claims, 7 Drawing Sheets

TWO STORY BUILDING COLLAPSED FOR SHIPPING

This invention relates to two story buildings and particularly to buildings composed of modules in which one or both stories may have its side walls collapsed and superposed over the floor therebelow for shipping.

Single story buildings constructed from modules which may be collapsed for shipping are well known. See U.S. Pat. No. 3,680,273. As shown in this patent the shipped modules may be erected, positioned side by side and the space between adjacent units bridged to provide a water tight building.

An object of this invention is to provide a two story building composed of modules which may be shipped with all walls in laid down position, or with the lower story walls and ceiling-floor in erected condition and with the upper story walls in laid down position.

Another object is to provide a two story building as in the preceding object in which water and sewage manifold are provided in selected modules and positioned in one or both of the base frame and in the ceiling-floor between the two stories.

Other object is to provide a two story building as in the preceding objects in which electrical conduits can be provided in either or both of the ceiling-floor between the two stories and in the ceiling of the upper story.

Other objects features and advantages of the invention will be apparent from the specification, the drawings, and the claims.

In the drawings wherein like reference numerals indicate like parts and wherein an illustrative embodiment of this invention is shown:

Figure 1:
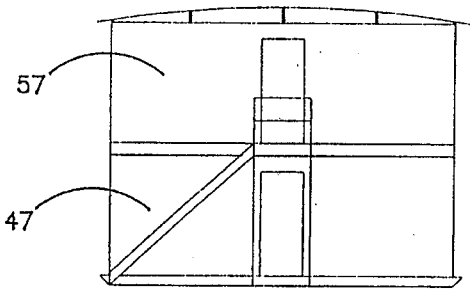
FIG. 1 is an end view in elevation of an erected building constructed in accordance with this invention.
Figures 6A, 6B:
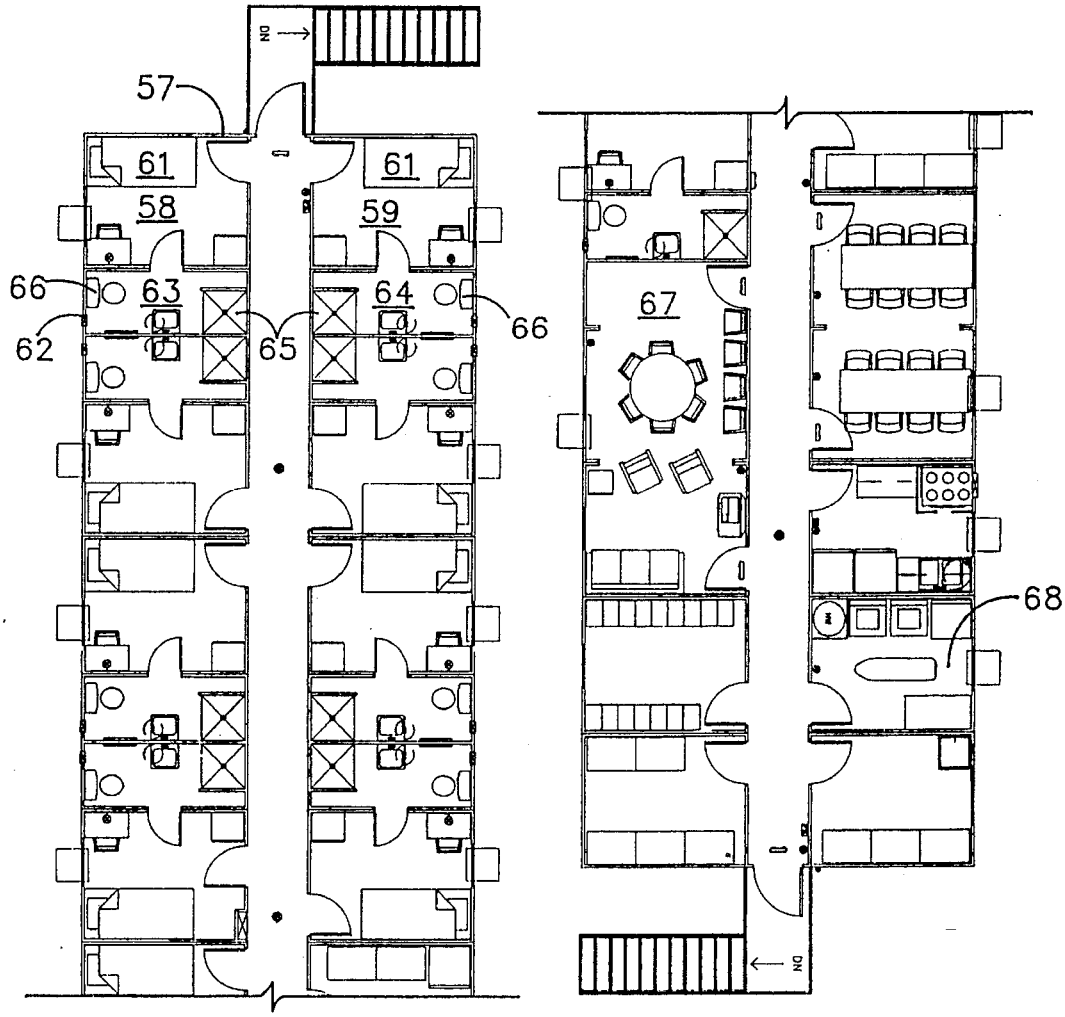
Figure 7A:
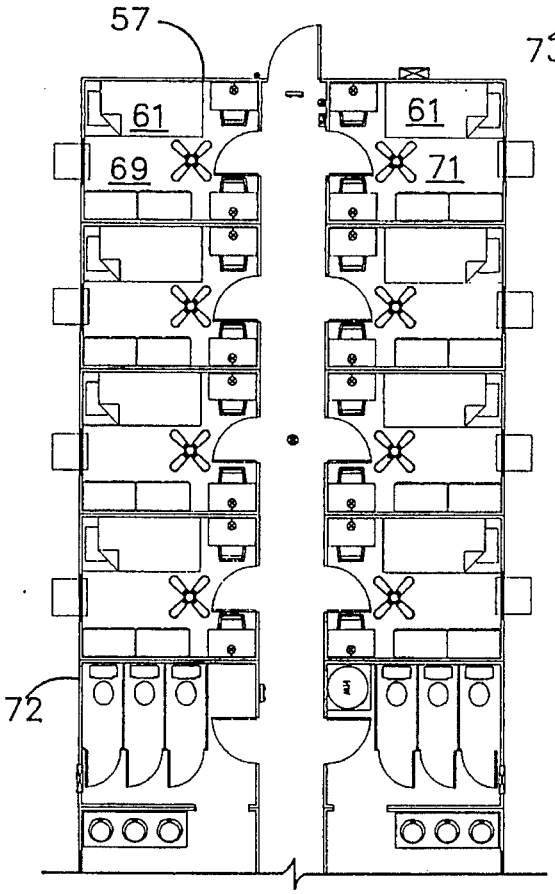
Figure 7B:
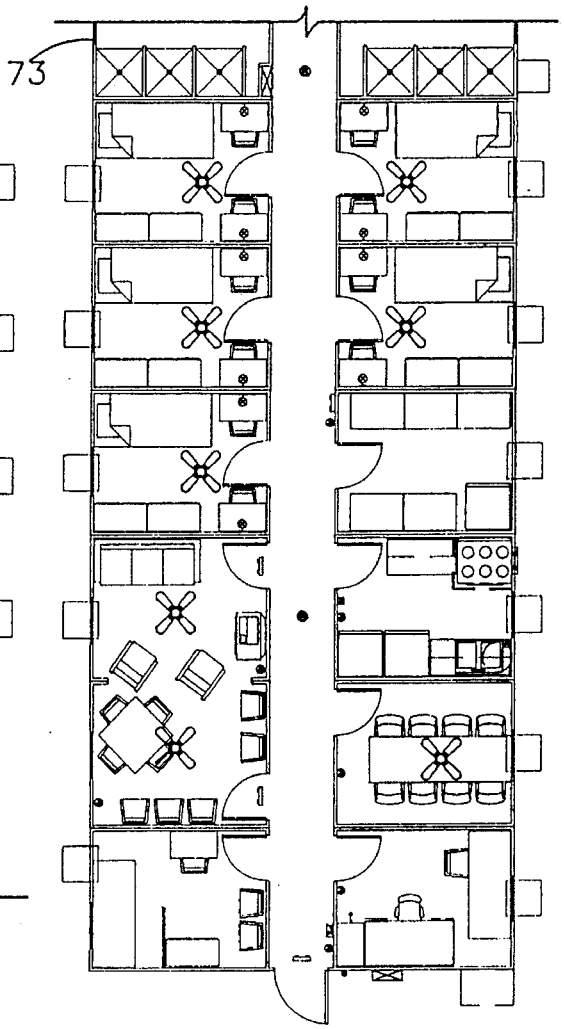
Figure 10:
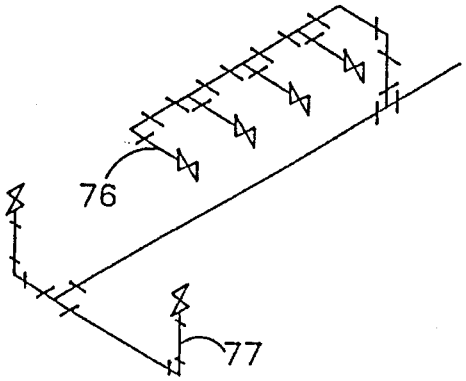
Figure 11:
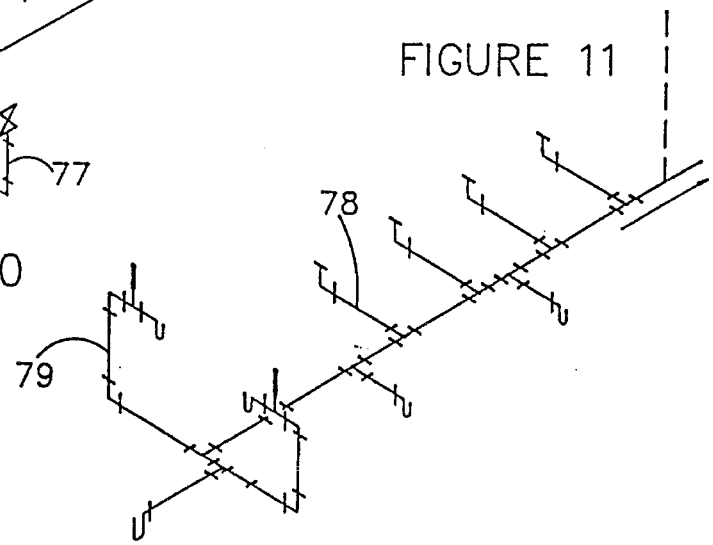
Figure 8:
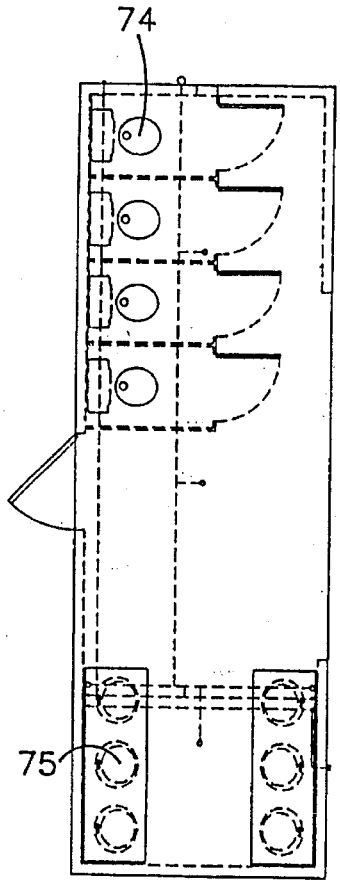
Figure 9:
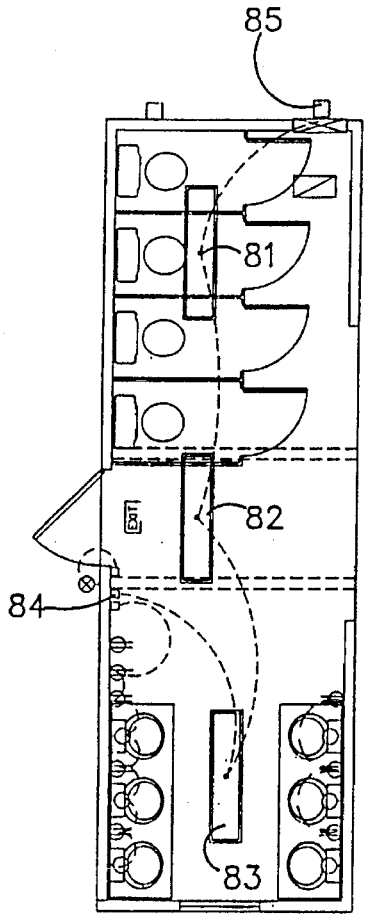
Figure 15:
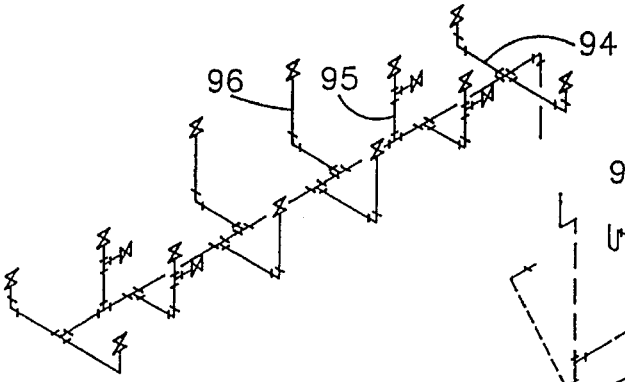
Figure 14:
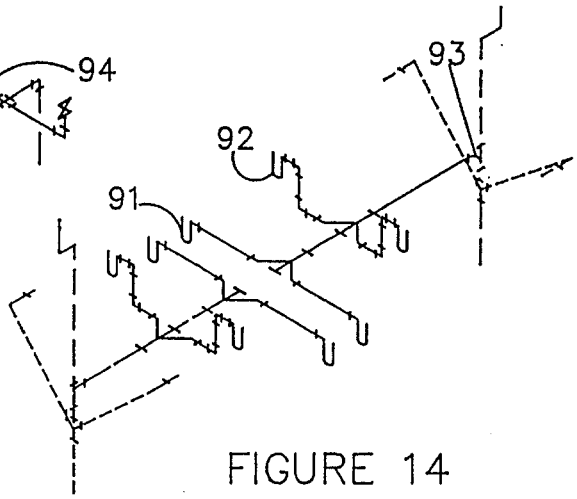
Figure 13:
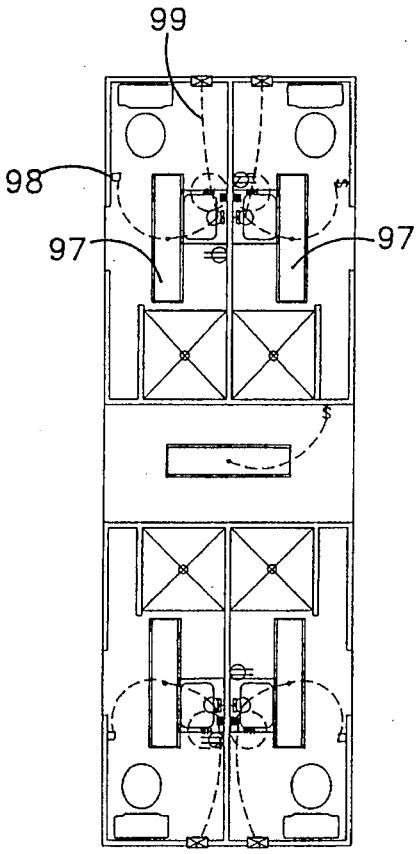
Figure 12:
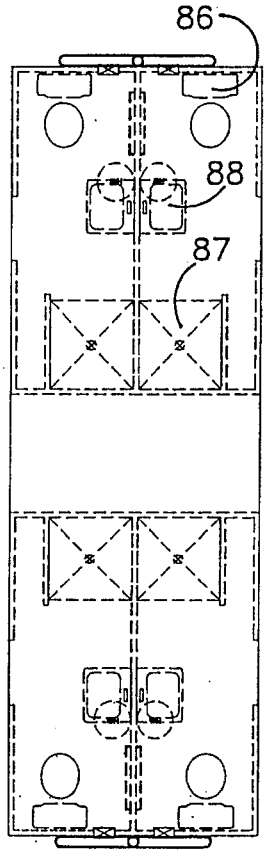

FIGS. 6*a* and 6*b* are continuation plan views of a typical upper story for the building of FIG. 1;

FIGS. 7*a* and 7*b* are continuation plan views of a typical lower story for the building of FIG. 1;

FIG. 8 is a schematic plumbing plan for the lower story of a module for the building of FIG. 1;

FIG. 9 is a schematic view similar to FIG. 8 adding lights and electrical conduit;

FIG. 10 is a schematic view of a water manifold for the module of FIG. 8;

FIG. 11 is a schematic view of a drain manifold for the module of FIG. 8;

FIG. 12 is a schematic plumbing plan for the upper story of a module for the building of FIG. 1;

FIG. 13 is a schematic view of the electrical plan for the module of FIG. 12;

FIG. 14 is a schematic view of the drain manifold for the module of FIG.12; and FIG. 15 is a schematic view of the water manifold for the module of FIG. 12.

Figure 2:
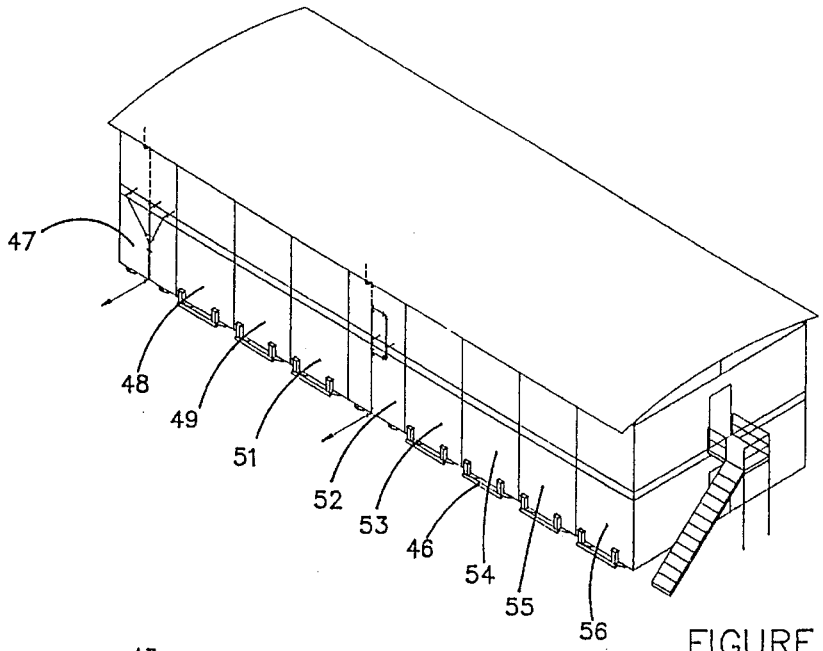
FIG. 2 is a view in elevation of the opposite end and one side view in elevation of the building of FIG. 1.
Figure 3:
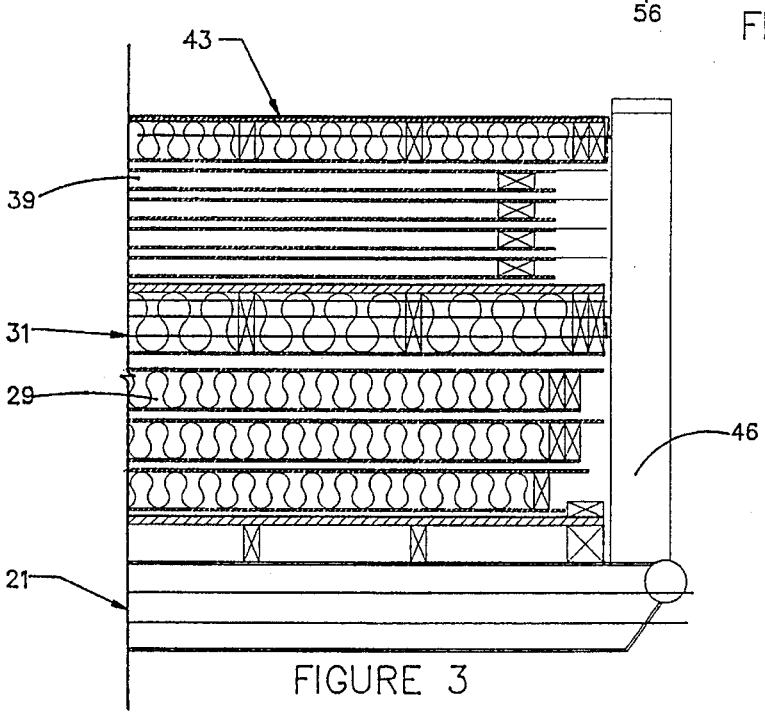
FIG. 3 is a partial cross sectional view of a module used in the building of FIG. 1 in knock-down shipping configuration illustrating the walls of both stories as well as the ceiling-floor and roof in knock-down position and superposed over the floor.
Figure 4:
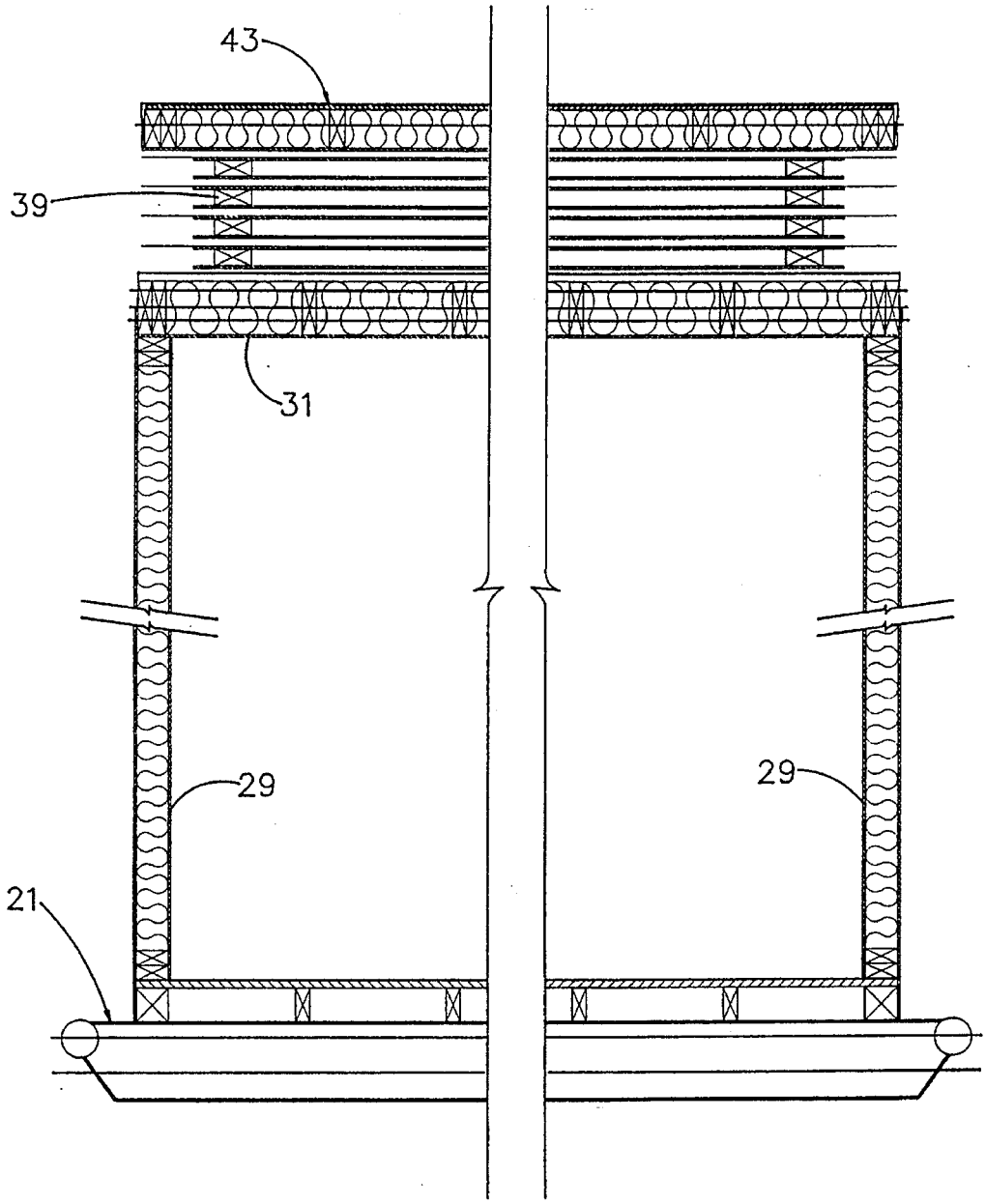
FIG. 4 is a partial cross sectional view of a module used in the building of FIG. 1 in knock-down shipping configuration illustrating the lower story walls and ceiling-floor between stories in erected condition and the upper walls in knock-down position superposed on the ceiling-floor and the shipping roof positioned over the upper floor walls.
Figure 5:
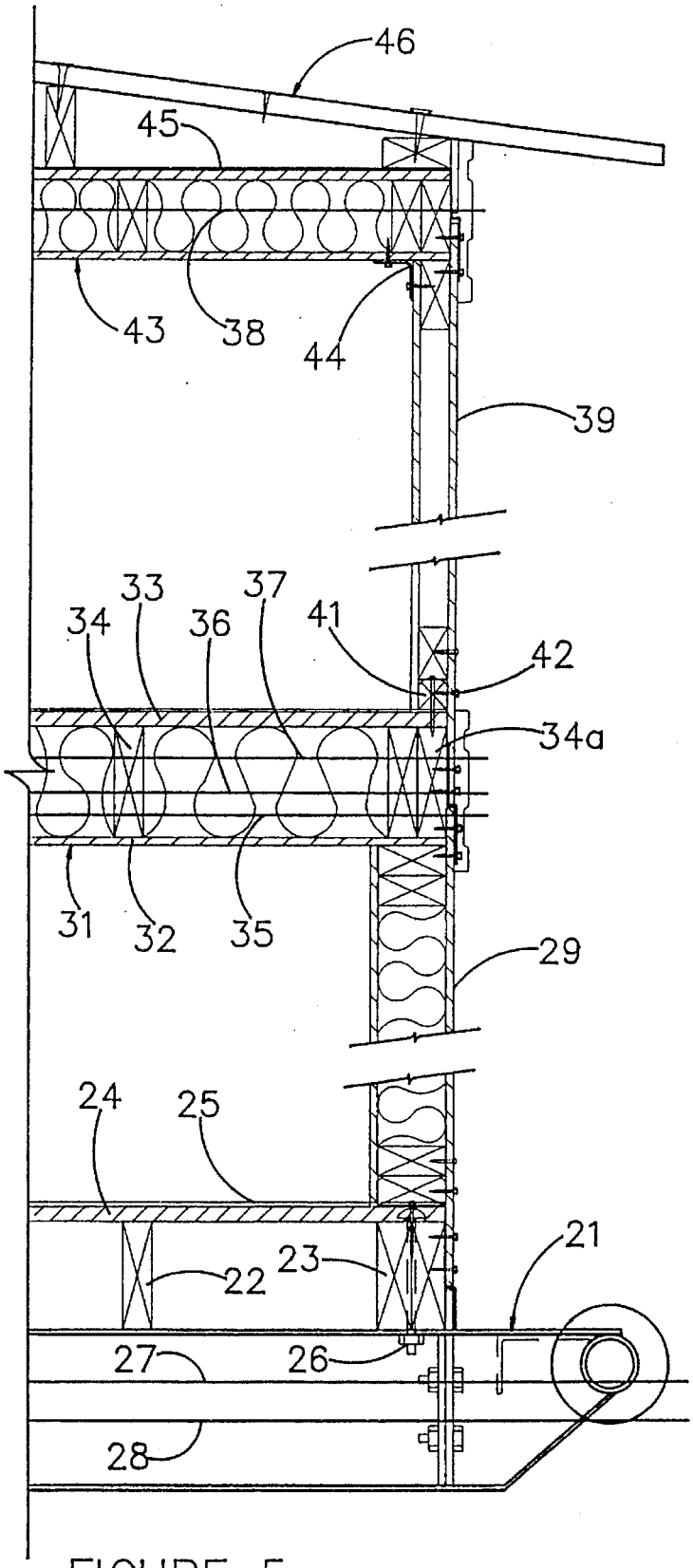
FIG. 5 is a partial sectional view through a module of the FIG. 1 building in erected condition and illustrating the water and sewage manifolds in the base frame and in the ceiling-floor between the two stories and electrical wiring in the ceiling-floor.

The two story building of FIGS. 1 and 2 is formed from modules which may be erected into the configuration illustrated in FIG. 5. In accordance with this invention the modules are shipped in either fully knock-down or partial knock-down condition as illustrated in FIGS. 3 and 4. The knock-down modules are then site erected to form the completed building. In FIG. 3 the modules are shipped with upper and lower story walls laid down to form the smallest cube for shipping. In FIG. 4 the modules are shipped with the lower story erected to permit factory installation of fixtures and provide shipping space. In either case the roof of each module protects the module. The laid down walls are protected on the sides by a sheet of material (not shown) as taught in U.S. Pat. No. 4,007,833. In accordance with this invention the ceiling-floor of one or more modules contains the water and drain manifolds for the upper story fixtures.

As shown in FIG. 5 each module includes a base frame provided by the skid shown generally at 21 supporting structural timbers such as two by four 22 and four by four 23. The structural timbers support a floor, such as plywood 24 which may be covered with sheet material 25. The structural members may be connected to the skid by bolts and nuts such as shown at 26.

Within the base frame of selected modules a water manifold 27 supplies water to fixtures (bath and/or kitchen) within the module. Also within the base frame sewage manifold 28 is provided to serve the fixtures.

A plurality of lower story prefabricated walls such as wall 29 are erected on the base frame.

Supported on the lower story walls is a ceiling-floor indicated generally at 31. The ceiling-floor includes a ceiling 32 for the lower story and a floor 33 for the upper story separated by structural members such as two by sixes 34 and four by sixes 34*a*.

Within the ceiling-floor 31 selected modules are provided with water manifold 35 and sewer manifold 36 for servicing fixtures within the upper story.

Also within the ceiling-floor 31 electrical conduits 37 are provided to service fixtures in the ceiling. If desired electrical conduits (not shown) may be provided in the lower walls 29 for switches, wall plugs, etc., and connected to the electrical conduits 37 during erection of the module.

Electrical service may also extend upwardly from the electrical conduits 37 to service the upper story. This service may be provided by electrical conduits 39 in the upper walls or by raceways attached to the interior of the upper walls and attached to conduit (not shown) in the upper ceiling. This service may be provided in the manner taught in U.S. Pat. No. 3,680,273 if desired. As an alternative, direct electrical service for the upper story may be provided by conduits 38 in the upper ceiling being connected direct to the power source.

The several upper walls 39 are erected on the ceiling floor and secured thereto in the conventional manner shown in the drawings as by securing a 2×2 timber 41 to the ceiling-floor 31 and securing the wall to the timber by drive screws 42 as shown.

The upper roof indicated generally at 43 is then attached to the upper walls in the conventional manner by brackets 44. The upper roof includes the roof material 45. This roof material 45 will protect the module during shipping and may provide the permanent roof. Alternatively a pitched roof as indicated generally at 46 may be erected over the modules.

The several modules are erected side by side to provide the building shown in FIGS. 1 and 2. Suitable seals are provided between adjacent module exterior side walls and the roof in the conventional manner. See U.S. Pat. No. 3,680,273.

Two alternative shipping modes are illustrated in FIGS. 3 and 4. In the FIG. 3 shipping mode all of the lower walls 29 and upper walls 39 are laid down and the ceiling-floor 31 and roof 43 are supperposed over the skid. If desired stacking racks 46 may be provided on the skid to support stacked modules in the conventional manner.

If desired one or more of the modules may be shipped with the lower story erected and the walls 39 of the upper story laid down as shown in FIG. 4. This permits the fixtures to be factory installed in the lower story and provides space for shipping furniture. In either the FIG. 3 or FIG. 4 shipping mode substantial reduction in cube space reduces shipping cost.

As shown in FIGS. 1 and 2 the modules shipped as shown in FIGS. 3 and 4 are erected as shown in FIG. 5 to provide a Building. Modules 47, 48, 49, 51, 52, 53, 54, 55, and 56 are erected to provide the building. If shipped as shown in FIG. 3 fixtures, furniture, lights etc. are field installed after the building is erected. If shipped as shown in FIG. 4 the fixtures furniture, lights etc. may be factory installed in the lower story and ceiling, and field installed in the upper story.

A typical upper floor plan is shown in FIGS. 6*a* and 6*b*. Module 57 has two rooms 58 and 59 equipped with conventional furniture including beds 61. Module 62 provides baths 63 and 64 for these bedrooms and is equipped with conventional bath fixtures including showers 65 and toilets 66. Other modules provide a conference room 67 and a kitchen 68.

A typical lower floor plan is shown in FIGS. 7*a* and 7*b*. The module 57 providing two rooms 69 and 71. Module 72 provides toilet facilities and module 73 provides bath facilities. As is apparent from these two floor plans as many modules as desired may be positioned together to provide the desired facilities. As many private rooms, conference rooms, food preparation and consumption facilities, etc. as desired may be provided.

FIG. 8 shows a typical lower toilet and lavatory facility having toilets 74 and lavatories 75. FIG. 10 illustrates a typical drain manifold including lines 76 for connection to the toilets and lines 77 for connection to the lavatories. FIG. 11 illustrates a typical water manifold including lines 78 for connection to the toilets and lines 79 for connection to the lavatories. These manifolds are positioned in the base frame of the module as shown in FIG. 5.

FIG. 9 adds to FIG. 8 the electrical fixtures including lights 80, 81, 82 and 83 which are mounted in the ceiling-floor of the module. Switches 84 controls the lights. Power is provided to the ceiling-floor wiring at 85.

FIG. 12 illustrates a typical upper module plan providing four private bath and toilet facilities. Each has a toilet 86, shower 87 and lavatory 88. FIG. 14 illustrates the drain manifold which is provided in the ceiling-floor for the FIG. 12 fixtures as shown in FIG. 5. Line 93 is connected to the toilet, line 92 to the lavatory and line 93 to the shower. FIG. 15 shows a typical water manifold positioned in the ceiling-floor as shown in FIG. 5 including lines 94, 95, and 96 for connection to the toilet, lavatory and shower respectfully.

FIG. 13 adds to FIG. 12 the electrical system including light fixtures 97 in the roof 43 controlled by switches 98. Wiring shown in dashed lines 99 extends through the roof and may receive power from the wiring in the ceiling-floor 31 or directly from the power source.

The foregoing disclosure and description of the invention are illustrative and explanatory thereof and various changes in the method and apparatus and system and in the size, shape and materials, as well as in the details of the illustrated construction, may be made within the scope of the claims without departing from the spirit of the invention.

What is claimed is:

1. A(a) portable building comprising:

a plurality of modules each comprising;

a base frame, a floor secured to said frame, a plurality of lower walls lying flat in superposed relationship on said floor, a prefabricated ceiling-floor superposed over said lower walls, a plurality of upper walls lying flat in superposed relationship on said ceiling-floor, and a root superposed above and covering said upper walls, said lower walls adapted to be erected on said base frame, said ceiling-floor adapted to be erected on said lower walls, said upper walls adapted to be erected on said ceiling-floor, said roof adapted to be erected on said upper walls; and water manifold means and drain manifold means in at least one of said base frames and in at least one of said ceiling-floors for supplying water to and draining fixtures, said water and drain manifold means in said ceiling-floors extending horizontally to the exterior of said ceiling-floors for connection to a water conduit and a drain conduit when the building is erected.

2. The building of claim 1 wherein electrical conduit means is provided in each ceiling-floor.

3. A (a) portable building comprising:

a plurality of modules each comprising;

a base frame, a floor secured to said frame, a plurality of lower walls erected on said frame, a prefabricated ceiling-floor erected on said lower walls, a plurality of upper walls lying flat in superposed relationship on said ceiling-floor, and a roof superposed above and covering said upper walls, said upper walls adapted to be erected on said ceiling-floor, said roof adapted to be erected on said upper walls; and water manifold means and drain manifold means in at least one of said base frames and in at least one of said ceiling-floors for supplying water to and draining fixtures, said water and drain manifold means in said ceiling-floors extending horizontally to the exterior of said ceiling-floors for connection to a water conduit and a drain conduit.

4. The building of claim 3 wherein electrical conduit means is provided in each ceiling-floor.

* * * * *